US012050069B2

(12) United States Patent
Suzuki et al.

(10) Patent No.: US 12,050,069 B2
(45) Date of Patent: Jul. 30, 2024

(54) HEAT EXCHANGE APPARATUS FOR COOLING OIL

(71) Applicants: JATCO Ltd, Fuji (JP); NISSAN MOTOR CO., LTD., Yokohama (JP)

(72) Inventors: Toshikazu Suzuki, Fuji (JP); Giljo Jung, Bucheon-shi (KR)

(73) Assignees: JATCO LTD, Fuji (JP); NISSAN MOTOR CO., LTD., Yokohama (JP)

( * ) Notice: Subject to any disclaimer, the term of this patent is extended or adjusted under 35 U.S.C. 154(b) by 153 days.

(21) Appl. No.: 17/910,254

(22) PCT Filed: Feb. 24, 2021

(86) PCT No.: PCT/JP2021/006772
§ 371 (c)(1),
(2) Date: Sep. 8, 2022

(87) PCT Pub. No.: WO2021/187026
PCT Pub. Date: Sep. 23, 2021

(65) Prior Publication Data

US 2024/0027145 A1 Jan. 25, 2024

(30) Foreign Application Priority Data

Mar. 16, 2020 (JP) ..... 2020-045880

(51) Int. Cl.
*F28F 9/04* (2006.01)
*F01M 5/00* (2006.01)
*F28D 21/00* (2006.01)

(52) U.S. Cl.
CPC ..... *F28F 9/04* (2013.01); *F01M 5/002* (2013.01); *F28D 21/00* (2013.01); *F28D 2021/0089* (2013.01); *F28F 2230/00* (2013.01)

(58) Field of Classification Search
CPC ..... F28F 9/04; F28F 2230/00; F28D 21/00; F28D 2021/0089; F01M 5/002
See application file for complete search history.

(56) References Cited

U.S. PATENT DOCUMENTS 3,743,011 A 7/1973 Frost
4,360,055 A 11/1982 Frost
4,862,955 A * 9/1989 Itakura ..... F28D 7/103 165/41
5,797,450 A 8/1998 Kawabe et al.
6,263,962 B1 7/2001 Komoda et al.
(Continued)

FOREIGN PATENT DOCUMENTS

CN 1464280 A * 12/2003
JP H06-084179 U 12/1994
(Continued)

*Primary Examiner* — Jon T. Schermerhorn, Jr.
(74) *Attorney, Agent, or Firm* — Foley & Lardner LLP

(57) ABSTRACT

An apparatus includes a case including a heat exchange unit; an inflow port through which a fluid flows into the heat exchange unit; and a discharge port through which the fluid is discharged from the heat exchange unit. In the case, the inflow port and the discharge port are opened in a facing surface facing a component to which the apparatus is assembled, the inflow port is disposed to face a fluid outlet of the component, and a partition wall that separates an inflow port side and a discharge port side is provided on the facing surface.

5 Claims, 12 Drawing Sheets

(56) References Cited

U.S. PATENT DOCUMENTS

| | | | | |
|---|---|---|---|---|
| 6,422,305 | B2 * | 7/2002 | Jainek | F01M 11/03 123/196 AB |
| 6,450,252 | B1 * | 9/2002 | Liao | F28D 7/12 165/154 |
| 7,216,736 | B2 * | 5/2007 | Yamamoto | F16H 57/0483 184/6.21 |
| 7,533,717 | B2 * | 5/2009 | Hummel | F28F 9/0075 165/178 |
| 8,911,620 | B2 * | 12/2014 | Silegren | B01D 35/18 123/196 AB |
| 11,274,884 | B2 * | 3/2022 | Thomas | F28D 9/005 |
| 2010/0206516 | A1 | 8/2010 | Muller-Lufft et al. | |
| 2017/0175599 | A1 | 6/2017 | Ariyama et al. | |

FOREIGN PATENT DOCUMENTS

| | | | |
|---|---|---|---|
| JP | H09-296991 | A | 11/1997 |
| JP | 2000-204920 | A | 7/2000 |
| JP | 2004-060974 | A | 2/2004 |
| JP | 2004-278985 | A | 10/2004 |
| JP | 5161709 | B2 | 3/2013 |
| JP | 2015-004468 | A | 1/2015 |
| JP | 2017-116135 | A | 6/2017 |
| JP | 2019-148245 | A | 9/2019 |
| WO | WO-2012/104077 | A1 | 8/2012 |

* cited by examiner

HEAT EXCHANGE APPARATUS FOR COOLING OIL

TECHNICAL FIELD

The present invention relates to an apparatus having a heat exchange function.

BACKGROUND ART

JP5161709B discloses an oil cooler.

This type of oil cooler is, for example, a heat exchange apparatus used for cooling oil (fluid) used for operation and lubrication of an automatic transmission.

When being used for cooling the oil of the automatic transmission, the oil cooler is attached to an outer periphery of a transmission case.

An outlet and an inlet of the oil are opened in the outer periphery of the transmission case, and an inflow port and a discharge port of the oil are opened in a portion of the oil cooler facing the transmission case.

When oil discharged from the outlet on a transmission case side flows to a discharge port side instead of flowing into the inflow port on an oil cooler side, the oil flowing to the discharge port side flows into the inlet on the transmission case side. Thus, uncooled oil is returned to the transmission case side.

In JP5161709B, the following configuration is adopted in order to prevent the oil discharged from the outlet on the transmission case side from flowing into the inlet on the transmission case side without passing through the oil cooler.

A plate component having a groove connecting the outlet on the transmission case side and the inflow port on the oil cooler side on a one-to-one basis is disposed between the oil cooler and the transmission case.

SUMMARY OF INVENTION

However, when an oil cooler is installed, the plate component is separately required.

Therefore, it is required to cause a larger amount of oil (fluid) to flow into the oil cooler (a heat exchange apparatus) with a simpler configuration.

According to an aspect of the present invention, an apparatus, including:

a case including a heat exchange unit;

an inflow port through which a fluid flows into the heat exchange unit; and a discharge port through which the fluid is discharged from the heat exchange unit, wherein in the case, the inflow port and the discharge port are opened in a facing surface facing a component to which the apparatus is assembled, the inflow port is disposed to face a fluid outlet of the component, and a partition wall that separates an inflow port side and a discharge port side is provided on the facing surface, is provided.

According to the above-mentioned aspect, a larger amount of fluid can flow to a heat exchange unit side.

DESCRIPTION OF EMBODIMENTS

Hereinafter, an embodiment of the invention will be described by taking an oil cooler 5 that is attached to a transmission case 1 of an automatic transmission as an example.

Figure 1A:
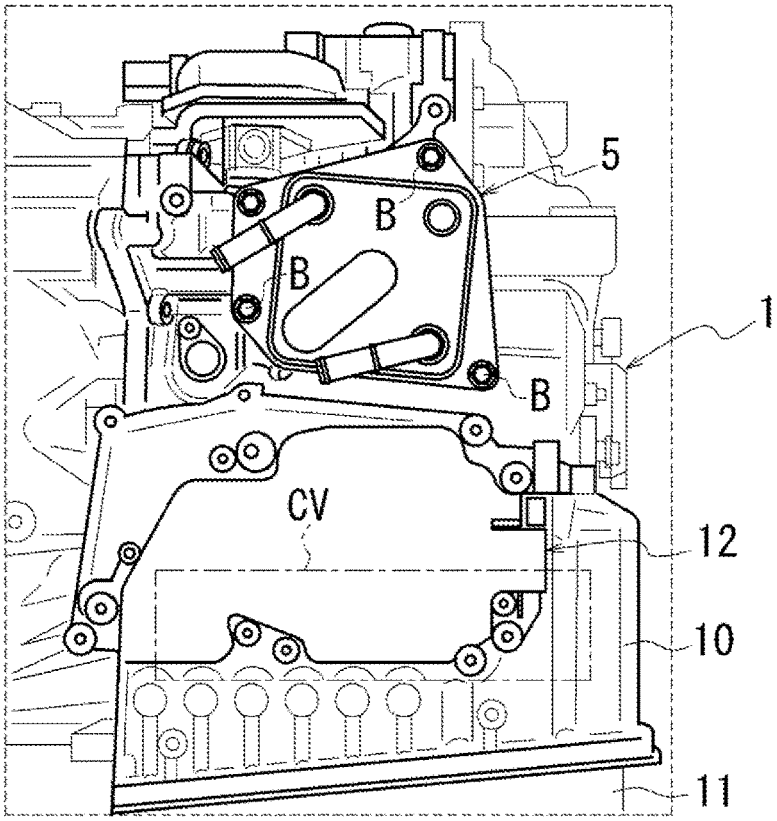
FIG. 1A is a view illustrating disposition of an oil cooler in a transmission case.
Figure 1B:
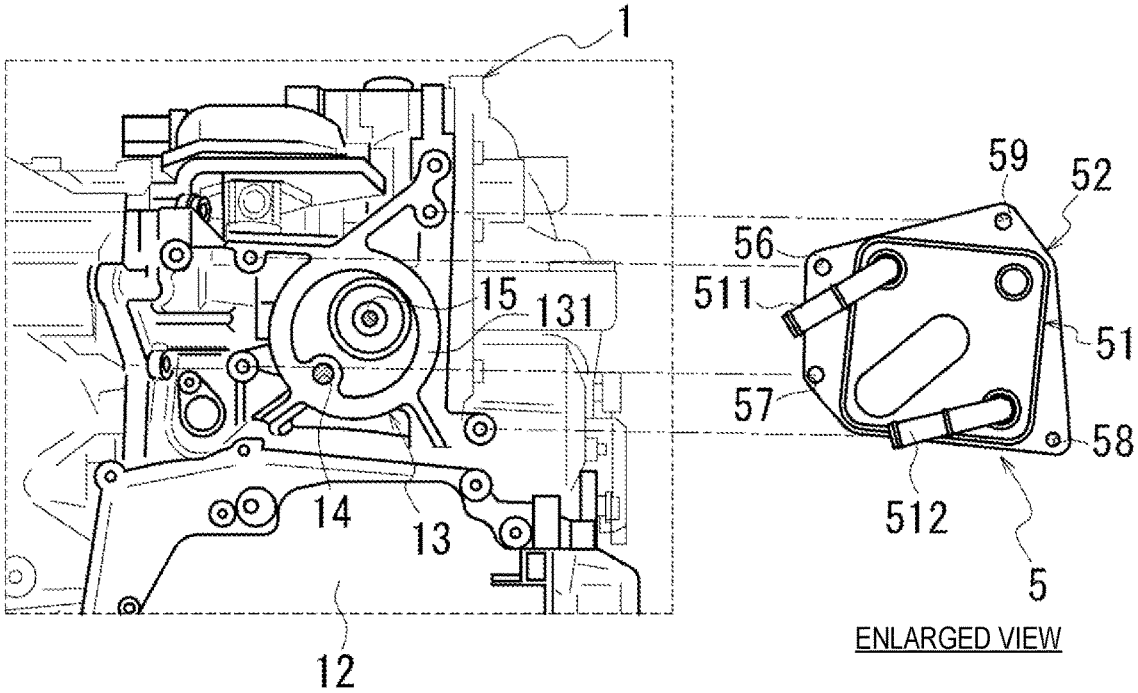
FIG. 1B is a view illustrating the disposition of the oil cooler in the transmission case.

FIG. 1A is a main portion enlarged view illustrating disposition of the oil cooler 5 in the transmission case 1. FIG. 1B is a view illustrating a state in which the oil cooler 5 is removed from the transmission case 1. In FIG. 1B, for easy understanding of positions of the oil holes 14 and 15, oil holes 14 and 15 are illustrated with intersected hatchings.

As illustrated in FIGS. 1A and 1B, in an automatic transmission for a vehicle, an accommodation portion 10 for a control valve CV is provided in a lower portion of the transmission case 1 that accommodates a transmission mechanism unit (not illustrated).

A lower portion of the accommodation portion 10 is opened, and the opening in the lower portion of the accommodation portion 10 is closed by an oil pan 11. Oil OL (fluid) used for operation, lubrication, cooling, and the like of the transmission mechanism unit and the like is stored in the oil pan 11.

The oil OL stored in the oil pan 11 is sucked through an oil strainer (not illustrated) attached to the control valve CV, and is supplied to a hydraulic control circuit (not illustrated) in the control valve CV.

The control valve CV regulates pressure of the oil OL and supplies the oil OL to the transmission mechanism unit or the like as hydraulic pressure for operation, while supplying a part of the sucked oil OL to the transmission mechanism unit or the like to lubricate and cool a rotating body, a friction engaging element, and the like.

The oil OL used for operation, lubrication, cooling, and the like of the transmission mechanism unit is returned to the oil pan 11 along an inner periphery of the transmission case 1 and the like due to its own weight, and is then supplied again to the control valve CV and used for operation, lubrication, cooling, and the like of the transmission mechanism unit and the like.

The oil OL used for cooling takes heat from the rotating body or the like of the transmission mechanism unit and rises in temperature. Therefore, the oil cooler 5 for cooling the oil OL is attached to the transmission case 1 of the automatic transmission.

Figure 2A:
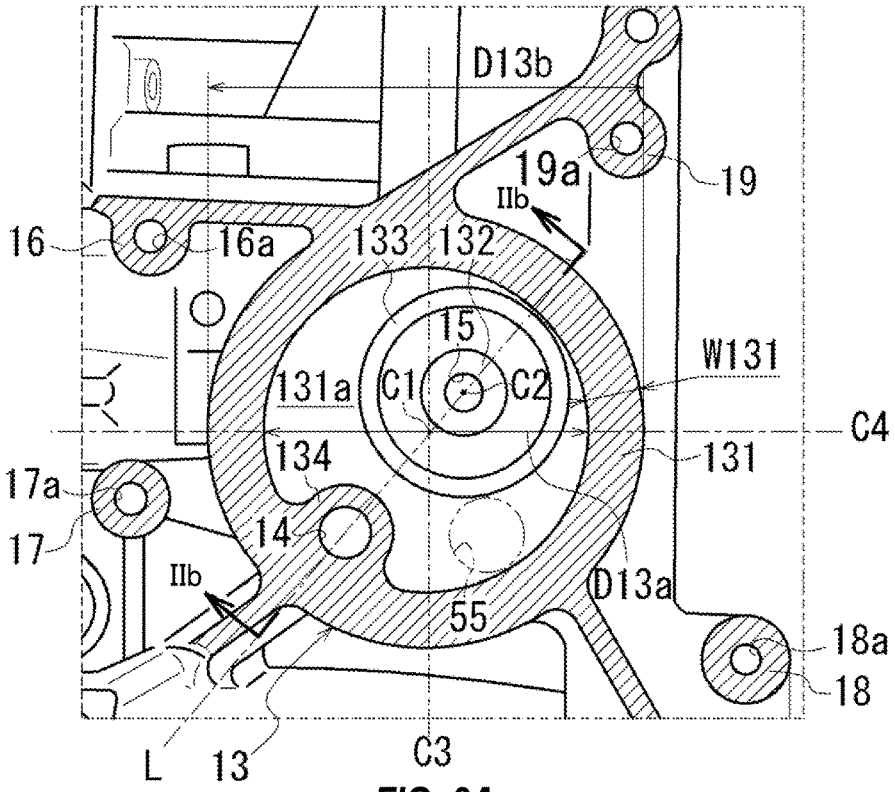
FIG. 2A is a view illustrating an attachment region of the oil cooler in the transmission case.
Figure 2B:
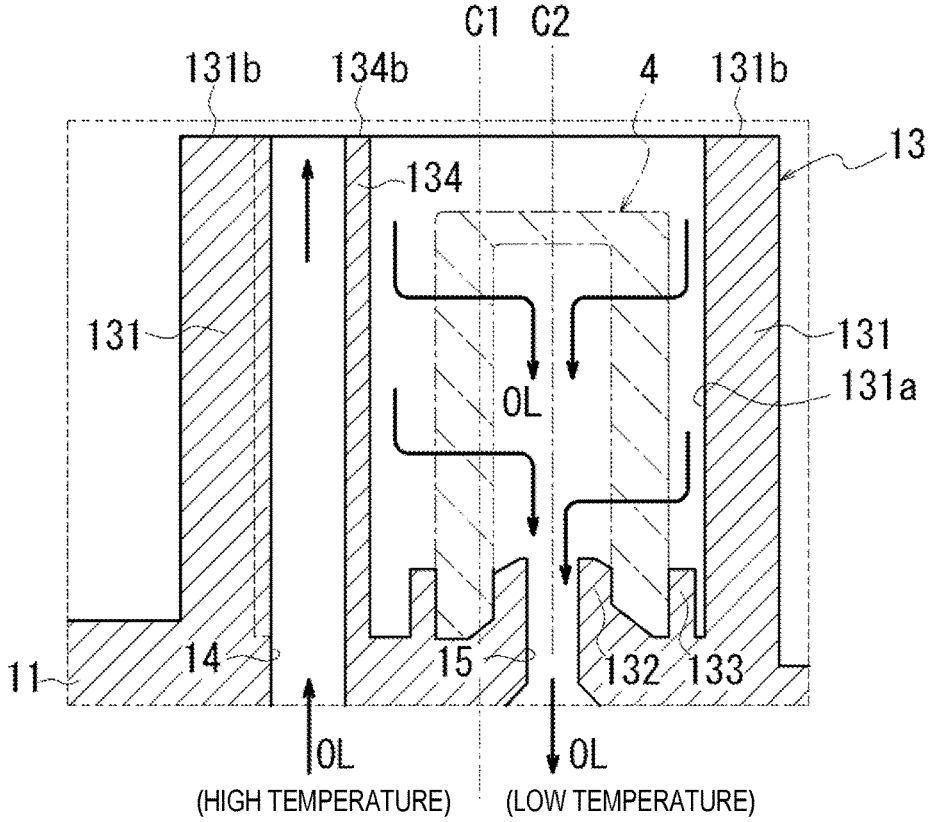
FIG. 2B is a view illustrating the attachment region of the oil cooler in the transmission case.

The oil cooler 5 is provided using an accommodation portion 13 of an oil filter 4 (see FIG. 2B). In the accommodation portion 13, the oil hole 14 serving as an outlet of the oil and an oil hole 15 serving as an inlet of the oil are opened.

In the automatic transmission, high-temperature oil discharged from the oil hole 14 is cooled by the oil cooler 5 and then is returned to a hydraulic control circuit side via the oil hole 15 and an oil passage in the transmission case 1.

The accommodation portion 13 has a peripheral wall portion 131 that is opened toward an outer side of the transmission case 1. The peripheral wall portion 131 is provided close to a box portion 12 that accommodates a control device (ATCU) of the automatic transmission and an oil pump.

The box portion 12 is formed so as to bulge from the outer periphery of the transmission case 1 toward a front side of the drawing sheet. The peripheral wall portion 131 is provided by utilizing a space on a lateral side of the box portion 12, and the peripheral wall portion 131 is also formed to bulge toward the front side of the drawing sheet.

FIG. 2A is an enlarged view of a region of the transmission case 1 in which the oil cooler 5 is attached. FIG. 2B is a cross-sectional view of the accommodation portion 13 of the oil filter 4 taken along a line IIb-IIb in FIG. 2A.

In FIG. 2A, for easy understanding of a position of a surface related to an attachment of the oil cooler 5, a surface to which a base plate 52 of the oil cooler 5 is joined is illustrated with hatchings.

As illustrated in FIG. 2A, boss portions 16, 17, 18, and 19 respectively having bolt holes 16*a*, 17*a*, 18*a*, and 19*a* are provided on an outer side of the peripheral wall portion 131.

When viewed from an opening direction of the peripheral wall portion 131, the boss portions 16, 17, 18, and 19 are provided at intervals in a peripheral direction around a center line C1 of the peripheral wall portion 131 formed into a circular shape.

The boss portions 16, 17, 18, and 19 of the peripheral wall portion 131 are formed so as to protrude from the outer periphery of the transmission case 1 toward the front side of the drawing sheet.

When the outer side of the peripheral wall portion 131 is separated into four regions with reference to straight lines C3 and C4 that are orthogonal to the center line C1 and are orthogonal to each other, the boss portions 16, 17, 18, and 19 are disposed in the respective regions.

As illustrated in FIG. 2A, a rib 134 having a substantially circular cross section is provided on an inner side of the peripheral wall portion 131. The rib 134 bulges from an inner periphery of the peripheral wall portion 131 toward the center line C1.

As illustrated in FIG. 2B, the rib 134 is formed over the entire length in a height direction of the peripheral wall portion 131 from an end surface 131*b* of the peripheral wall portion 131.

The oil hole 14 is opened at a center of the rib 134. The oil hole 14 is provided along a longitudinal direction of the rib 134. The oil hole 14 communicates with the hydraulic control circuit (not illustrated) via the oil passage in the transmission case 1. The oil OL, which rises in temperature after cooling the rotating body of the transmission mechanism unit, is supplied to the oil hole 14.

An end surface 134*b* of the rib 134 is on the same plane as the end surface 131*b* of the peripheral wall portion 131.

The end surface 134*b* of the rib 134 and the end surface 131*b* of the peripheral wall portion 131 form a joint surface with the base plate 52 (see FIG. 3B) of the oil cooler 5.

Inside the peripheral wall portion 131, a cylindrical wall portion 132 to which the oil filter 4 is externally fitted is provided on a side opposite to the rib 134 as viewed from the center line C1.

A support wall portion 133 having an inner diameter larger than that of the cylindrical wall portion 132 is provided on an outer side of the cylindrical wall portion 132 so as to be concentric with the cylindrical wall portion 132.

The oil hole 15 is opened at a center of the cylindrical wall portion 132. The oil hole 15 communicates with an oil passage (not illustrated) on the hydraulic control circuit side, and the oil OL that passes through the oil filter 4 is returned to the hydraulic control circuit (not illustrated) side through the oil hole 15.

A center line C2 of the cylindrical wall portion 132 is provided at a position offset from the center line C1 of the peripheral wall portion 131 toward the peripheral wall portion 131 side (an outer diameter side of the center line C1). The oil filter 4 fitted into the support wall portion 133 is disposed close to the inner periphery of the peripheral wall portion 131.

Figure 3A:
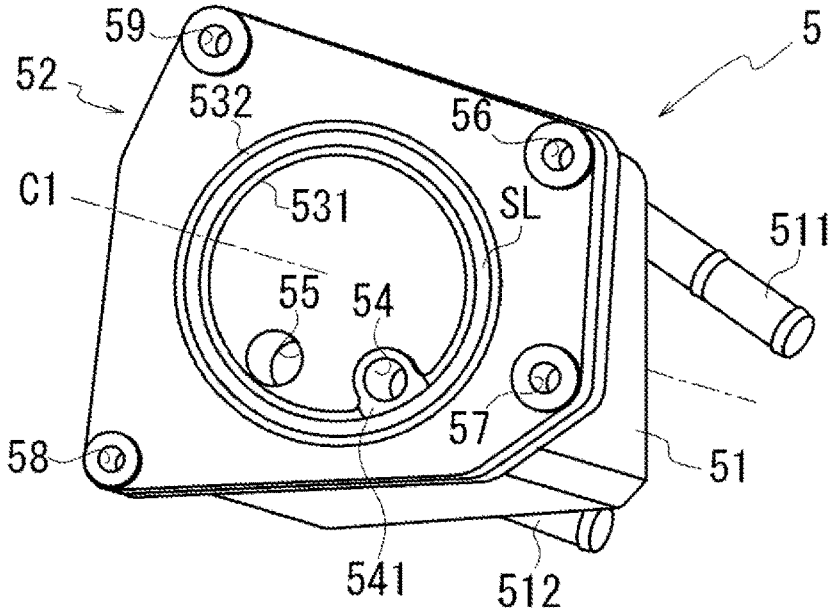
FIG. 3A is a view illustrating a base plate of the oil cooler.
Figure 3B:
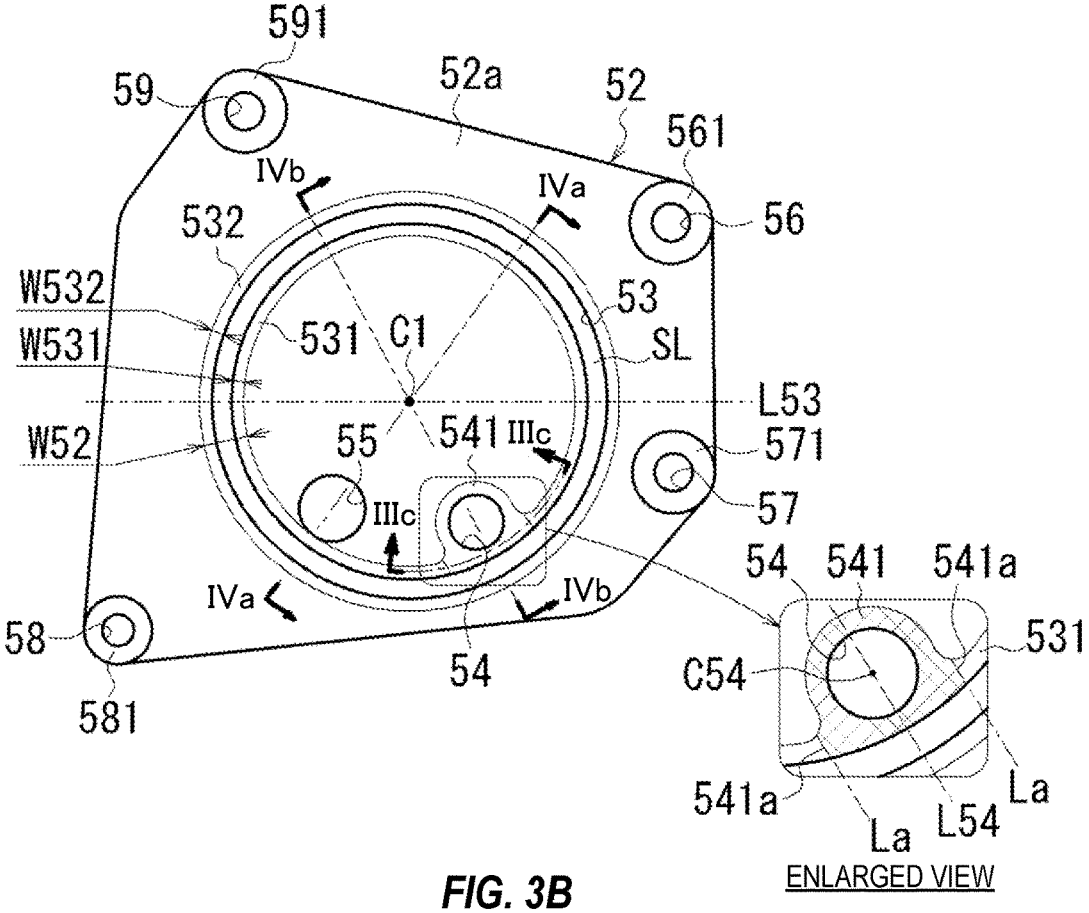
FIG. 3B is a view illustrating the base plate of the oil cooler.
Figure 3C:
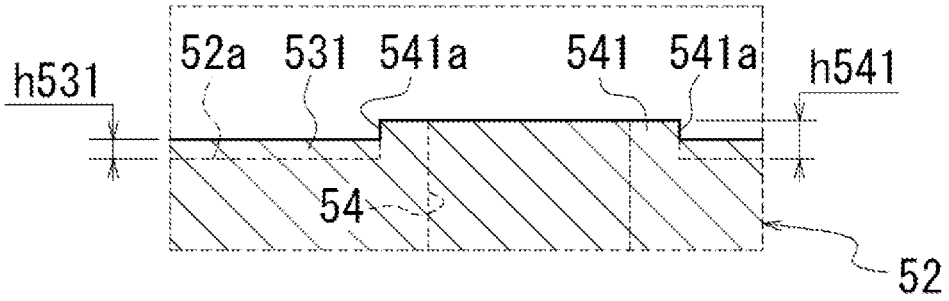
FIG. 3C is a view illustrating the base plate of the oil cooler.

FIG. 3A is a perspective view of the oil cooler 5 as viewed from a transmission case 1 side. FIG. 3B is a plan view of the base plate 52 of the oil cooler 5 as viewed from the transmission case 1 side. FIG. 3C is a cross-sectional view of the base plate 52 taken along a line IIIc-IIIc in FIG. 3B. In FIG. 3C, for easy understanding of a difference in height on a facing surface 52*a*, heights h531 and h541 of an inner annular wall portion 531 and a partition wall portion 541 protruding from the facing surface 52*a* are illustrated exaggeratedly.

Figure 4A:
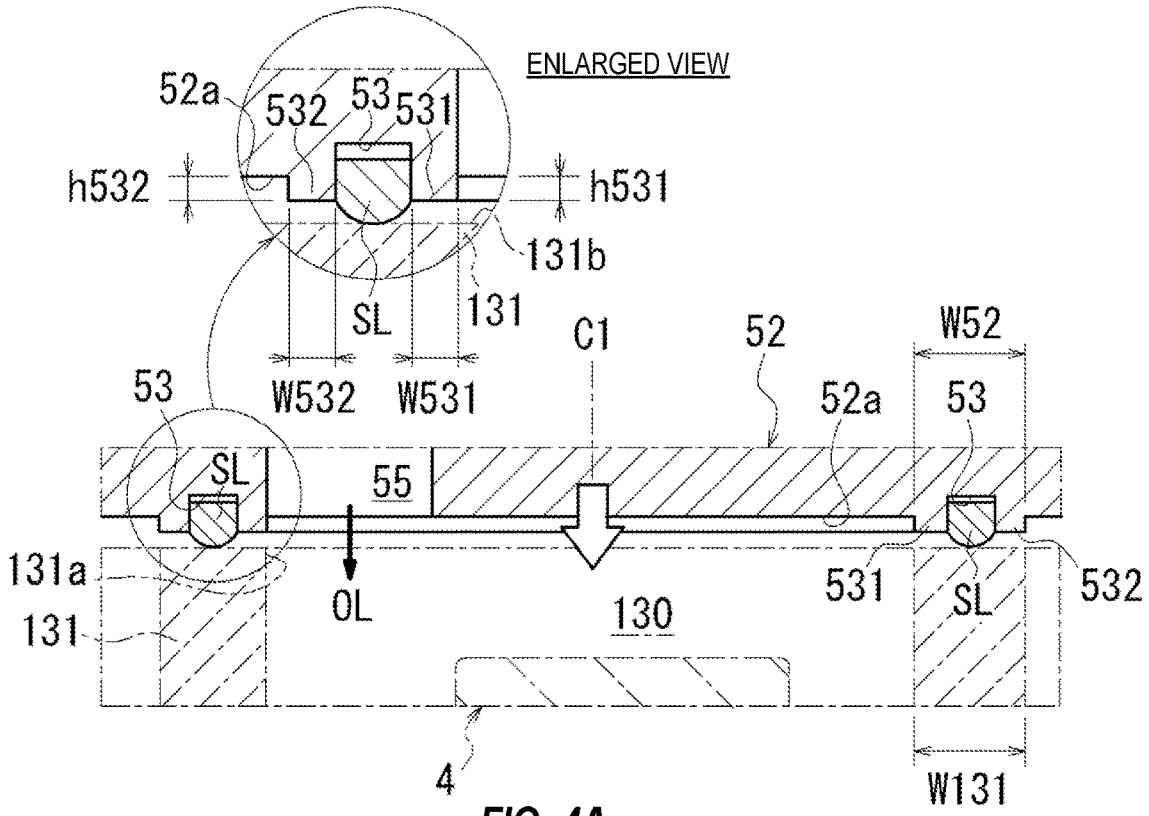
FIG. 4A is a view illustrating the base plate of the oil cooler.
Figure 4B:
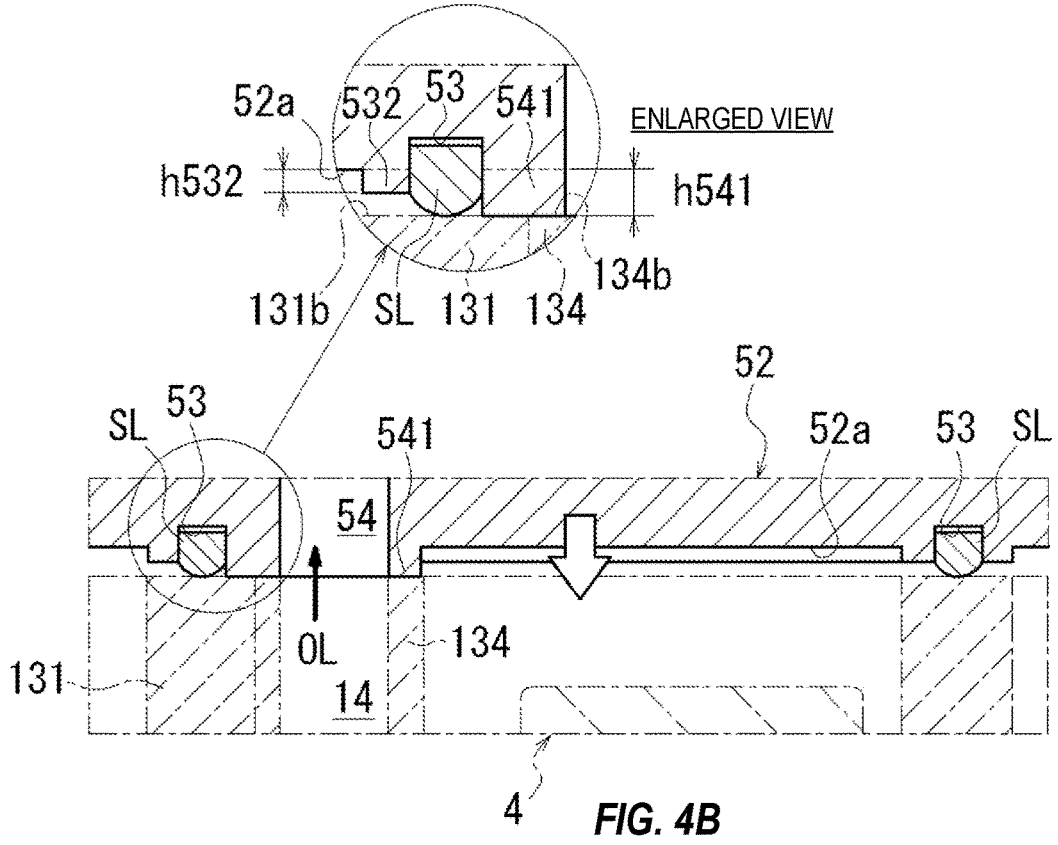
FIG. 4B is a view illustrating the base plate of the oil cooler.

FIG. 4A is a cross-sectional view of the base plate 52 taken along a line IVa-IVa in FIG. 3B. FIG. 4B is a cross-sectional view of the base plate 52 taken along a line IVb-IVb in FIG. 3B.

In FIGS. 4A and 4B, for easy understanding of a difference in height on the facing surface 52*a*, and heights h531, h532, and h541 of the inner annular wall portion 531, an outer annular wall portion 532, and the partition wall portion 541, which protrude from the facing surface 52*a*, are illustrated exaggeratedly.

The oil cooler 5 includes: a main body case 51 (a case) to which a supply pipe 511 and a discharge pipe 512 of a coolant are connected; and the base plate 52 provided on a facing surface of the main body case 51 facing the transmission case.

An inside of the main body case 51 is a heat exchange unit in which a flow passage of the coolant and a flow passage of the oil are disposed so as to enable heat exchange.

The base plate 52 is a plate-shaped member formed to have a size that covers an opening 131*a* (see FIG. 2A) of the peripheral wall portion 131 on the transmission case 1 side. The base plate 52 is formed of a metal material having higher hardness than a constituent material (aluminum alloy or the like) of the transmission case 1.

Bolt holes 56, 57, 58, and 59 are opened in an outer peripheral portion of the base plate 52.

Ring-shaped seating surfaces 561, 571, 581, and 591 surrounding the bolt holes 56, 57, 58, and 59 are provided on the facing surface 52*a* of the base plate 52 facing the transmission case 1.

In the present embodiment, when the oil cooler 5 is assembled to the accommodation portion 13 of the oil filter 4, the seating surfaces 561, 571, 581, and 591 come into surface contact with the corresponding boss portions 16, 17, 18, and 19, respectively.

Accordingly, engaging pressures of bolts B that are screwed into the bolt holes 16*a*, 17*a*, 18*a*, and 19*a* of the boss portions 16, 17, 18, and 19 through the bolt holes 56, 57, 58, and 59 substantially uniformly acts on the boss portions 16, 17, 18, and 19.

Further, a ring groove 53 that accommodates a seal ring SL is provided in the facing surface 52*a* of the base plate 52.

The ring groove 53 is provided in a region facing the peripheral wall portion 131 when the oil cooler 5 is assembled to the accommodation portion 13 of the oil filter 4 and fixed by the bolts B.

The ring groove 53 is formed to have an inner diameter larger than an inner diameter D13*a* (see FIG. 2A) of the peripheral wall portion 131 and an outer diameter smaller than an outer diameter D13*b* (see FIG. 2A) of the peripheral wall portion 131.

Accordingly, when the oil cooler 5 is assembled to the accommodation portion 13 of the oil filter 4, the seal ring SL accommodated in the ring groove 53 is brought into pressure contact with the end surface 131*b* of the peripheral wall portion 131 over the entire periphery.

Therefore, the oil OL inside the peripheral wall portion 131 does not leak from the joint surface between the base plate 52 on the oil cooler 5 side and the peripheral wall portion 131 on the transmission case 1 side.

Further, on the facing surface 52*a*, the inner annular wall portion 531 surrounding the inner circumference of the ring groove 53 over the entire circumference and the outer annular wall portion 532 surrounding the outer circumference of the ring groove 53 over the entire circumference are formed so as to bulge toward the front side of the drawing sheet in FIG. 3B.

As illustrated in FIG. 4A, the height h531 of the inner annular wall portion 531 from the facing surface 52*a* is the same as the height h532 of the outer annular wall portion 532 from the facing surface 52*a*.

Further, a width W531 of the inner annular wall portion 531 in a radial direction of the center line C1 is the same as a width W532 of the outer annular wall portion 532 in the radial direction of the center line C1.

As illustrated in FIG. 3B, the inner annular wall portion 531 and the outer annular wall portion 532 are formed to have the width W531 and the width W532 that are the same, respectively, over the entire circumference in the circumferential direction around the center line C1.

A width W52 from an inner periphery of the inner annular wall portion 531 to an outer periphery of the outer annular wall portion 532 is substantially the same as a width W131 of the peripheral wall portion 131 in the radial direction.

In the facing surface 52*a*, an inflow port 54 of the oil OL and a discharge port 55 of the oil OL are opened at positions inscribed in the inner annular wall portion 531.

The inflow port 54 is an inflow port of the oil OL flowing to the heat exchange unit in the main body case 51 of the oil cooler 5. The discharge port 55 is a discharge port of the oil OL cooled by the heat exchange unit in the main body case 51.

The inflow port 54 and the discharge port 55 are disposed close to each other on one side (a lower side in FIG. 3B) of a diameter line L53 passing through a center of the ring groove 53.

The discharge port 55 has a circular shape inscribed in the inner annular wall portion 531. The inflow port 54 is formed into a circular shape having a size matching the oil hole 14 on the transmission case 1 side. The inflow port 54 is formed to have an opening diameter slightly smaller than that of the discharge port 55.

The partition wall portion 541 surrounding the inflow port 54 is formed on the facing surface 52*a*. As viewed from the center line C1, an outer diameter side of the partition wall portion 541 is formed to have a range overlapping the inner annular wall portion 531.

The height h541 of the partition wall portion 541 from the facing surface 52*a* is higher than the height h531 of the inner annular wall portion 531 from the facing surface 52*a* (see FIG. 3C).

In a region of the partition wall portion 541 overlapping the inner annular wall portion 531, two side edges 541*a* and 541*a* in the peripheral direction around the center line C1 are formed in a linear shape along straight lines La and La. The two side edges 541*a* and 541*a* cross the inner annular wall portion 531 from the inner diameter side to the outer diameter side.

The straight lines La and La are straight lines located symmetrically with respect to a diameter line L54 passing through a center C54 of the inflow port 54 with the diameter line L54 interposed therebetween.

In the present embodiment, the inner annular wall portion 531 and the outer annular wall portion 532 of the facing surface 52*a* of the base plate 52, and the partition wall portion 541 are formed by press molding.

The inner annular wall portion 531, the outer annular wall portion 532, and the partition wall portion 541 are in contact with the end surface 131*b* of the peripheral wall portion 131 forming the accommodation portion 13 for the oil filter 4 and the end surface 134*b* of the rib 134 inscribed in the peripheral wall portion 131.

In this state, when the base plate 52 of the oil cooler 5 is fixed to the transmission case 1 by the bolts B, the inner annular wall portion 531, the outer annular wall portion 532, and the partition wall portion 541 are brought into pressure contact with the end surface 131*b* of the peripheral wall portion 131 and the end surface 134*b* of the rib 134 at a pressure corresponding to engaging forces of the bolts B.

As described above, the peripheral wall portion 131 and the rib 134 on the transmission case 1 side are formed of an aluminum alloy, and the inner annular wall portion 531, the outer annular wall portion 532, and the partition wall portion 541 are formed of a metal material having higher hardness than the aluminum alloy.

Therefore, a contact interface between the base plate 52 of the oil cooler 5 and filter 4 and the peripheral wall portion 131 and the rib 134 is metal-sealed.

Therefore, the oil OL flowing from the oil hole 14 in the rib 134 on the transmission case 1 side into the inflow port 54 on the oil cooler 5 side is less likely to leak from a contact interface between the end surface 134*b* of the rib 134 and the partition wall portion 541.

Further, after being cooled by the oil cooler 5, the oil OL discharged from the discharge port 55 to a space inside the peripheral wall portion 131 is less likely to leak from a contact interface between the end surface 131*b* of the peripheral wall portion 131 and the inner annular wall portion 531 and the outer annular wall portion 532.

Hereinafter, the assembling of the oil cooler 5 to the peripheral wall portion 131 of the transmission case 1 will be described.

When assembling the oil cooler 5 to the transmission case 1, the oil cooler 5 is superposed on the peripheral wall portion 131 of the transmission case 1 such that the bolt holes 56, 57, 58, and 59 (see FIG. 1B) of the base plate 52 are superposed on the bolt holes 16*a*, 17*a*, 18*a*, and 19*a* (see FIG. 2A) of the boss portions 16, 17, 18, and 19.

Thus, the inflow port 54 on the oil cooler 5 side is disposed at a position overlapping with the oil hole 14 (see FIG. 4B) on the transmission case 1 side, and the discharge port 55 on the oil cooler 5 side is disposed at a position overlapping with the opening 131*a* of the peripheral wall portion 131 (see an imaginary line in FIG. 4A).

In this state, the partition wall portion 541 surrounding the inflow port 54 is in contact with the end surface 134*b* of the rib 134, and the seal ring SL is in contact with the end surface 131*b* of the peripheral wall portion 131 over the entire periphery (see FIG. 4B).

In this state, the bolts B that are screwed into the bolt holes 16*a*, 17*a*, 18*a*, and 19*a* (see FIG. 2A) of the boss portions 16, 17, 18, and 19 through the bolt holes 56, 57, 58, and 59 are fastened (see FIG. 3B).

Thus, as illustrated in FIG. 4B, the partition wall portion 541 surrounding the inflow port 54 is brought into pressure contact with the end surface 134*b* of the rib 134 surrounding the oil hole 14 at a pressure corresponding to the engaging pressures of the bolts.

When the bolts are further fastened, as illustrated in FIG. 4A, the inner annular wall portion 531 on the inner diameter side of the ring groove 53 and the outer annular wall portion 532 on the outer diameter side of the ring groove 53 are brought into pressure contact with an inner diameter side and an outer diameter side of the region of the end surface 131*b* of the peripheral wall portion 131 where the seal ring SL is brought into pressure contact.

Figure 5A:
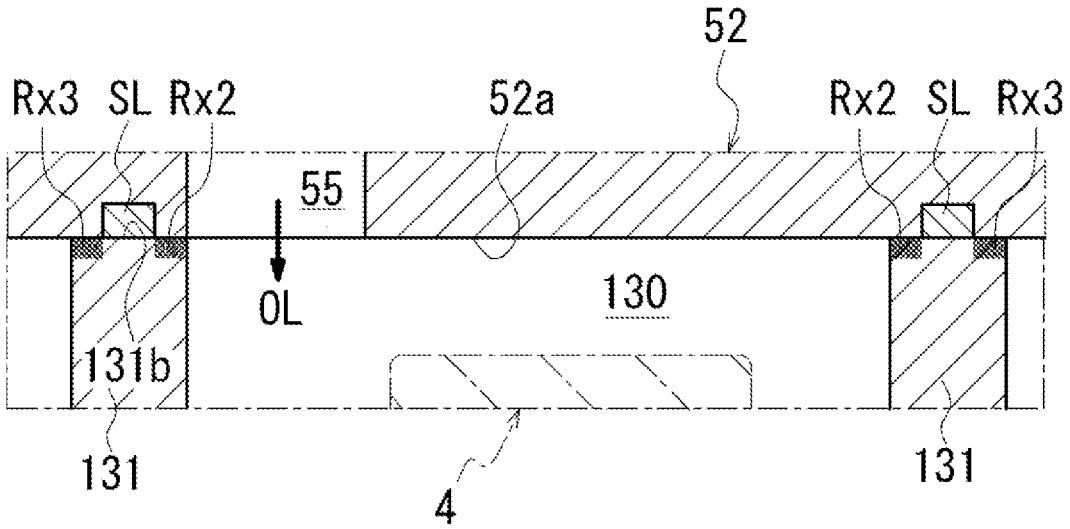
FIG. 5A is a view illustrating a metal touch region when the oil cooler is assembled to the transmission case.
Figure 5B:
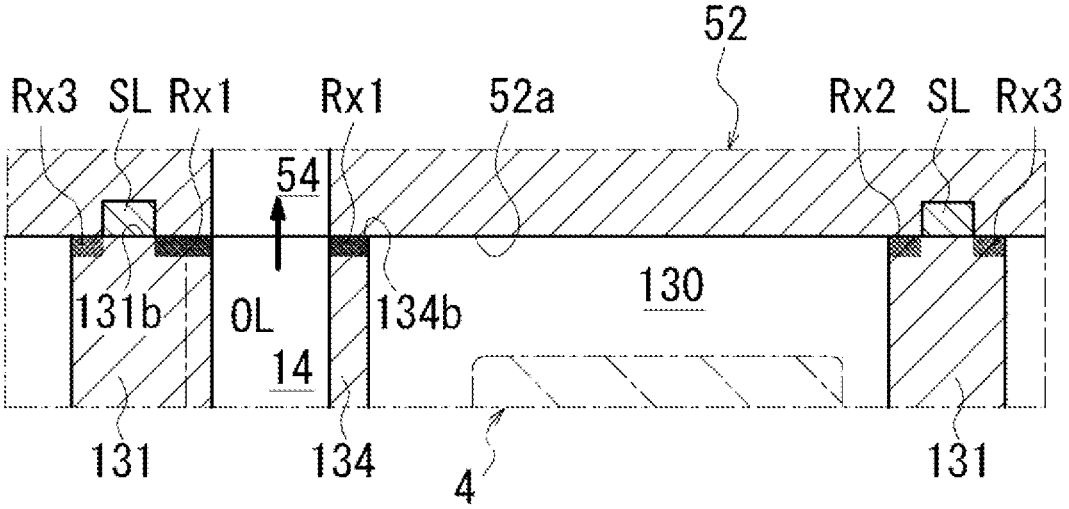
FIG. 5B is a view illustrating the metal touch region when the oil cooler is assembled to the transmission case.

Thus, as illustrated in FIGS. 5A and 5B, a metal touch region Rx1 formed due to the partition wall portion 541, a metal touch region Rx2 formed due to the inner annular wall portion 531, and a metal touch region Rx3 formed due to the outer annular wall portion 532 are formed at the contact interface (a joint interface) between the base plate 52 and the peripheral wall portion 131.

As a result, the oil hole 14 and the inflow port 54 communicate with each other, the contact interface between the rib 134 and the partition wall portion 541 of the base plate 52 is metal-sealed, and the oil OL is less likely to leak from the contact interface.

Therefore, the high-temperature oil OL flowing through the oil hole 14 can be prevented from not flowing into the inflow port 54 and leaking from the contact interface between the rib 134 and the base plate 52 to a space 130 inside the peripheral wall portion 131. Accordingly, the oil OL can be suitably prevented from returning to the hydraulic control circuit side from the oil hole 15 without passing through the oil cooler 5.

There is no need to separately dispose a plate component having a groove that connects the oil hole 14 (the outlet) on the transmission case 1 side and the inflow port 54 on the oil cooler 5 side on a one-to-one basis between the base plate 52 on the oil cooler 5 side and the peripheral wall portion 131 on the transmission case 1 side.

Further, the space 130 inside the peripheral wall portion 131 is sealed by the seal ring SL that is brought into pressure contact with the end surface 131*b* of the peripheral wall portion 131, and by the metal touch regions Rx1, Rx2, and Rx3. Therefore, the oil OL is less likely to leak from the contact interface between the end surface 131*b* of the peripheral wall portion 131 and the base plate 52 as compared with a case where only the seal ring SL is brought into pressure contact with the end surface 131*b* of the peripheral wall portion 131.

FIGS. 6A to 8D are views illustrating base plates 52A to 52L according to modifications of the oil cooler 5.

In the above-described embodiment, the base plate 52 is described as an example in which the inner annular wall portion 531 along the inner periphery of the ring groove 53, the outer annular wall portion 532 along the outer periphery of the ring groove 53, and the partition wall portion 541 surrounding the inflow port 54 are formed to protrude from the facing surface 52*a* facing the transmission case 1.

In the base plate 52, the partition wall portion 541 surrounding the inflow port 54 is brought into pressure contact with the end surface 134*b* of the rib 134 on the transmission case 1 side, thereby preventing leakage of the oil OL from the contact interface between the base plate 52 and the rib 134, and ensuring an amount of the oil OL flowing into the inflow port 54.

The base plate 52 is not limited to this form. For example, the base plates 52A to 52H illustrated in FIGS. 6A to 6D and FIGS. 7A to 7D may be used.

Figure 6A:
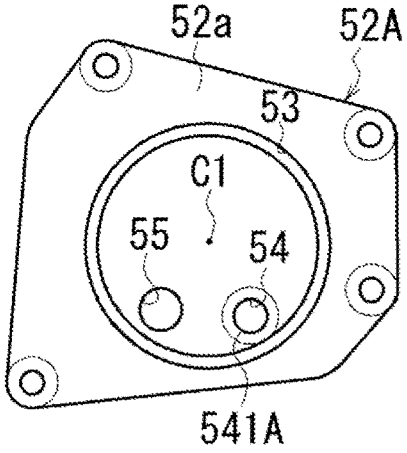
FIG. 6A is a view illustrating a partition wall according to a modification.

The base plate 52A illustrated in FIG. 6A is provided with a ring-shaped partition wall portion 541A, surrounding the inflow port 54, on the facing surface 52*a* facing the transmission case 1. The partition wall portion 541A is inscribed in the inner periphery of the ring groove 53.

When the base plate 52A is assembled to the transmission case 1, the partition wall portion 541A is brought into pressure contact with a peripheral edge of the oil hole 14 on the transmission case 1 side over the entire periphery to form a metal touch region.

In the case of the base plate 52A, leakage of the oil OL from the contact interface between the partition wall portion 541A on the facing surface 52*a* side and the peripheral edge of the oil hole 14 on the transmission case 1 side can also be suitably suppressed, so that an inflow amount of the oil OL discharged from the oil hole 14 into the inflow port 54 can be ensured.

Figure 6B:
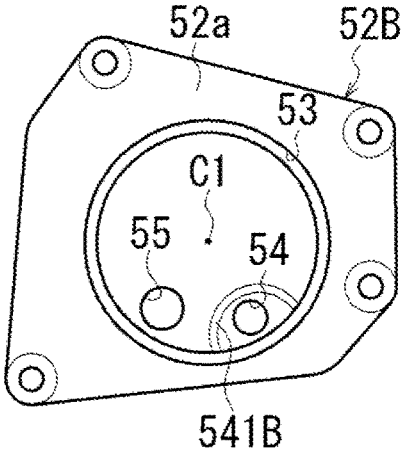
FIG. 6B is a view illustrating a partition wall according to a modification.

The base plate 52B illustrated in FIG. 6B is provided with, on the facing surface 52*a* facing the transmission case 1, an arc-shaped partition wall portion 541B surrounding a peripheral region of the inflow port 54 so as to bulge toward the front side of the drawing sheet. One end and the other end of the partition wall portion 541B reach the inner periphery of the ring groove 53.

Therefore, when the base plate 52B is assembled to the transmission case 1, an annular wall surrounding the inflow port 54 is formed by the seal ring SL accommodated in the ring groove 53 and the partition wall portion 541B.

In the base plate 52B, when the oil OL leaks from the contact interface between the facing surface 52*a* and the peripheral edge of the oil hole 14 on the transmission case 1 side, the annular wall prevents the leaked oil OL from moving.

When a flow of the oil OL leaked from the contact interface is prevented, a total amount of the oil leaking from the contact interface is also suppressed, so that the inflow amount of the oil OL discharged from the oil hole 14 into the inflow port 54 can be ensured.

Figure 6C:
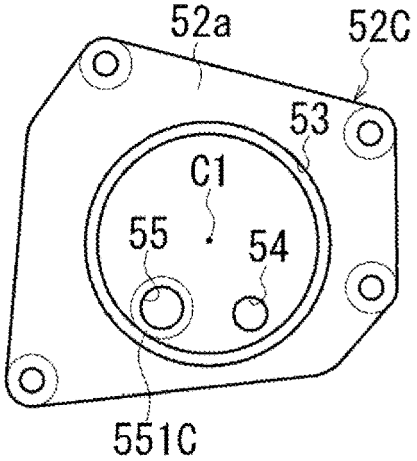
FIG. 6C is a view illustrating a partition wall according to a modification.

The base plate 52C illustrated in FIG. 6C is provided with, on the facing surface 52*a* facing the transmission case 1, a ring-shaped partition wall portion 551C surrounding the discharge port 55 so as to bulge toward the front side of the drawing sheet, and the partition wall portion 551C is inserted into the inner side of the peripheral wall portion 131 on the transmission case 1 side.

In the case of the base plate 52C, the oil OL leaked to the inner side of the peripheral wall portion 131 from the contact interface between the facing surface 52*a* and the peripheral edge of the oil hole 14 on the transmission case 1 side hardly reaches the discharge port 55.

Therefore, a flow of the oil OL discharged from the discharge port 55 after passing through the heat exchange unit from the inflow port 54 is not blocked by the oil OL leaked to the inner side of the peripheral wall portion 131. When distribution of the oil OL from the discharge port 55 is blocked, a capacity of the heat exchange unit is limited, and thus there is a possibility that a problem may occur in inflow of the oil OL into the inflow port 54.

In the base plate 52C, the flow of the oil OL discharged from the discharge port 55 is not blocked and no problem occurs in the inflow of the oil OL into the inflow port 54, so that the inflow amount of the oil OL discharged from the oil hole 14 into the inflow port 54 can be ensured.

Figure 6D:
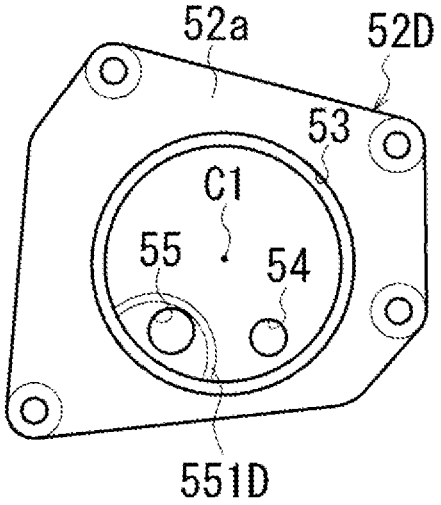
FIG. 6D is a view illustrating a partition wall according to a modification.

The base plate 52D illustrated in FIG. 6D is provided with an arc-shaped partition wall portion 551D surrounding a peripheral region of the discharge port 55 so as to bulge toward the front side of the drawing sheet.

One end and the other end of the partition wall portion 551D reach the inner periphery of the ring groove 53.

Therefore, when the base plate 52D is assembled to the transmission case 1, an annular wall surrounding the discharge port 55 is formed by the seal ring SL accommodated in the ring groove 53 and the partition wall portion 551D.

In the case of the base plate 52D, the oil OL leaked to the inner side of the peripheral wall portion 131 from the contact interface between the facing surface 52*a* and the peripheral edge of the oil hole 14 on the transmission case 1 side hardly reaches the discharge port 55.

Therefore, the flow of the oil OL discharged from the discharge port 55 after passing through the heat exchange unit from the inflow port 54 is not significantly blocked by the oil OL leaked to the inner side of the peripheral wall portion 131, so that the inflow amount of the oil OL discharged from the oil hole 14 into the inflow port 54 can be ensured for the reason described above.

Figure 7A:
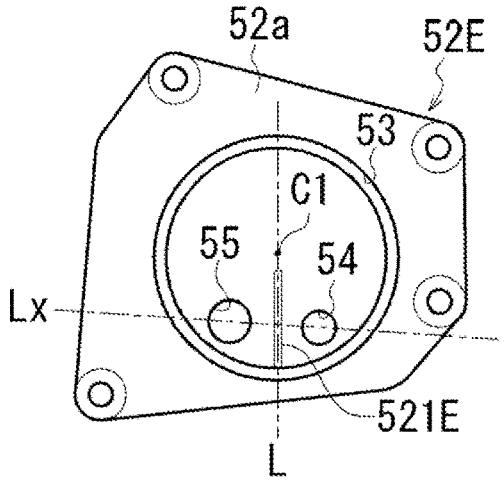
FIG. 7A is a view illustrating a partition wall according to a modification.

In the base plate 52E illustrated in FIG. 7A, a linear partition wall portion 521E is provided on the facing surface 52*a* facing the transmission case 1 so as to bulge toward the front side of the drawing sheet. The partition wall portion 521E is provided across a straight line Lx that connects centers of the inflow port 54 and the discharge port 55. The partition wall portion 521E extends along a straight line L passing through a center line C1 of the base plate 52E, and extends from the ring groove 53 to a vicinity of the center line C1 of the base plate 52E.

Figure 7B:
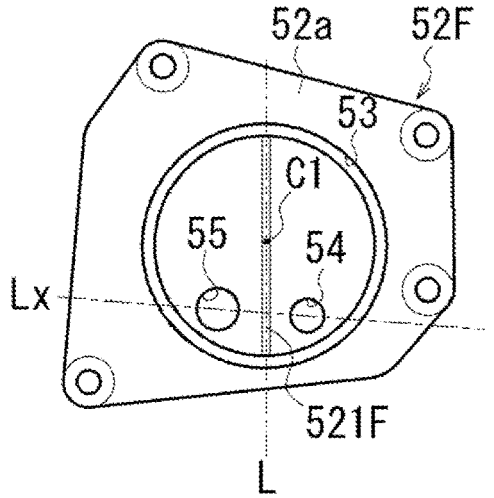
FIG. 7B is a view illustrating a partition wall according to a modification.

In the base plate 52F illustrated in FIG. 7B, a linear partition wall portion 521F is provided on the facing surface 52*a* facing the transmission case 1 so as to bulge toward the front side of the drawing sheet. The partition wall portion 521F is provided across the straight line Lx that connects the centers of the inflow port 54 and the discharge port 55. The partition wall portion 521F extends along the straight line L passing through the center line C1 of the base plate 52F, and one end and the other end of the partition wall portion 521F in a longitudinal direction reach the ring groove 53, respectively.

The partition wall portions 521E and 521F may have a wavy shape or an arc shape instead of a linear shape.

Figure 7C:
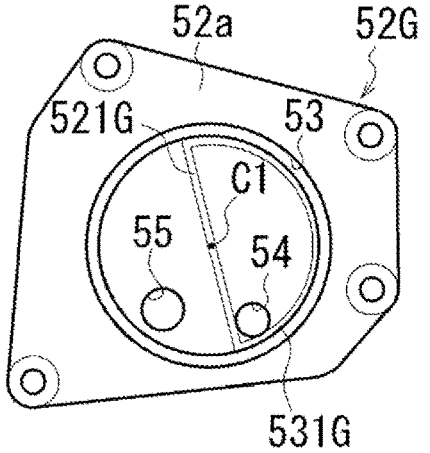
FIG. 7C is a view illustrating a partition wall according to a modification.

In the base plate 52G illustrated in FIG. 7C, a semicircular surrounding wall is formed by an inner annular wall portion 531G along the inner periphery of the ring groove 53 and a linear partition wall portion 521G passing through the center line C1, so as to bulge toward the front side of the drawing sheet, and the inflow port 54 is opened inside the surrounding wall.

Figure 7D:
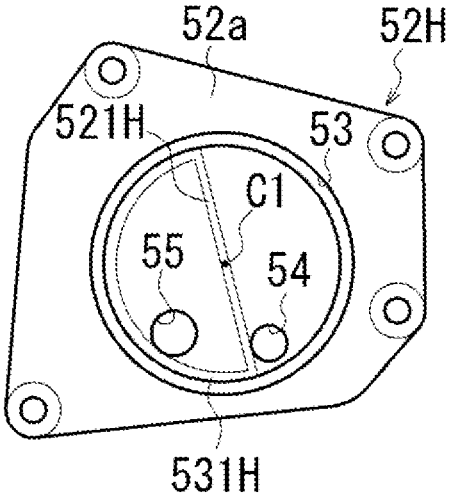
FIG. 7D is a view illustrating a partition wall according to a modification.

In the base plate 52H illustrated in FIG. 7D, a semicircular surrounding wall is formed by an inner annular wall portion 531H along the inner periphery of the ring groove 53 and a linear partition wall portion 521H passing through the center line C1, so as to bulge toward the front side of the drawing sheet, and the discharge port 55 is opened inside the surrounding wall.

In these base plates 52E to 52H, the oil OL leaked to the inner side of the peripheral wall portion 131 from the contact interface between the facing surface 52*a* and the peripheral edge of the oil hole 14 on the transmission case 1 side also hardly reaches the discharge port 55.

Therefore, the flow of the oil OL discharged from the discharge port 55 after passing through the heat exchange unit from the inflow port 54 is not significantly blocked by the oil OL leaked to the inner side of the peripheral wall portion 131, so that the inflow amount of the oil OL discharged from the oil hole 14 into the inflow port 54 can be ensured for the reason described above.

Here, the above-described partition wall portion 541A protrudes from the facing surface 52*a* facing the transmission case 1. Therefore, when only the partition wall portion 541A is provided on the facing surface 52*a*, there is a possibility that the oil cooler 5 is inclined with the partition wall 541A as a fulcrum.

Figure 8A:
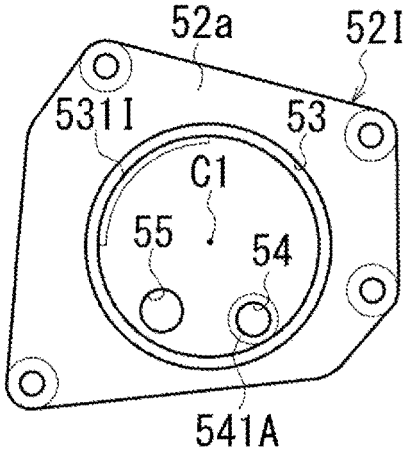
FIG. 8A is a view illustrating a partition wall according to a modification.

In the base plate 52I illustrated in FIG. 8A, an arc-shaped wall portion 531I along the inner periphery of the ring groove 53 is provided on a side opposite to the partition wall portion 541A as viewed from the center line C1.

Figure 8B:
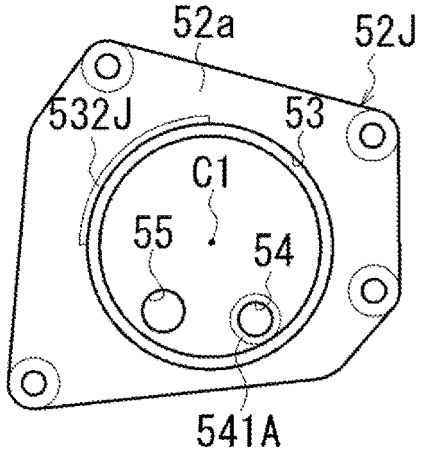
FIG. 8B is a view illustrating a partition wall according to a modification.

In the base plate 52J illustrated in FIG. 8B, an arc-shaped wall portion 532J along the outer periphery of the ring groove 53 is provided on the side opposite to the partition wall portion 541A as viewed from the center line C1.

Figure 8C:
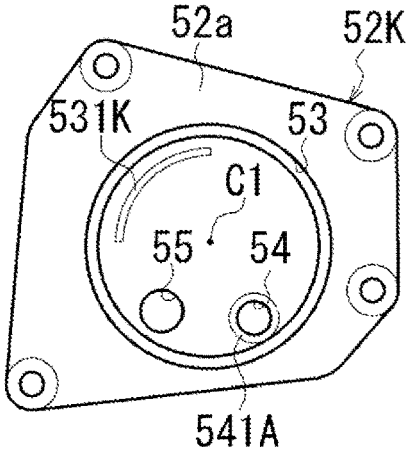
FIG. 8C is a view illustrating a partition wall according to a modification.

In the base plate 52K illustrated in FIG. 8C, an arc-shaped wall portion 531K is provided at a position, offset to the inner diameter side from the ring groove 53, on the side opposite to the partition wall portion 541A as viewed from the center line C1.

Figure 8D:
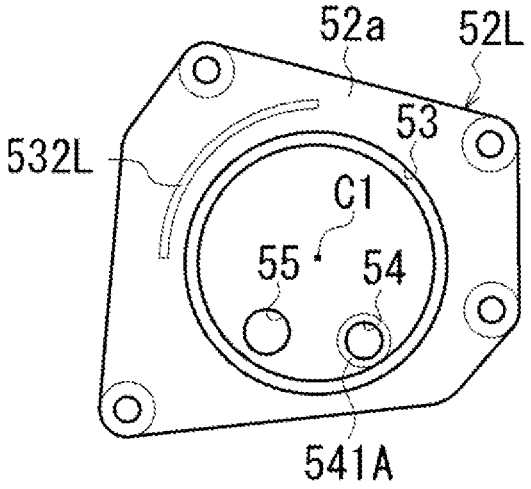
FIG. 8D is a view illustrating a partition wall according to a modification.

In the base plate 52L illustrated in FIG. 8D, an arc-shaped wall portion 532L is provided at a position, offset to the outer diameter side from the ring groove 53, on the side opposite to the partition wall portion 541A as viewed from the center line C1.

In these base plates 521 to 52L, by providing the arc-shaped wall portions 531I, 531K, 532J, and 532L separately from the partition wall portion 541A, the oil cooler 5 can be suitably prevented from being inclined.

The arc-shaped wall portions 531I, 531K, 532J, and 532L may be used in any combination.

As described above, the oil cooler 5 according to the present embodiment has the following configurations.

(1) The oil cooler 5 (an apparatus) includes:

the main body case 51 (a case) including the heat exchange unit;

the inflow port 54 through which the oil OL (a fluid) flows into the heat exchange unit; and the discharge port 55 through which the oil OL is discharged from the heat exchange unit.

In the main body case 51, the inflow port 54 and the discharge port 55 are opened in the facing surface 52*a* facing the transmission case 1 to which the oil cooler 5 is assembled.

The inflow port 54 is disposed to face the oil hole 14 which is a fluid outlet on the transmission case 1 side.

On the facing surface 52*a*, the partition wall portion 541 (a partition wall) that separates an inflow port 54 side and a discharge port 55 side is provided so as to protrude toward the transmission case 1 side.

With this configuration, the partition wall portion 541 blocks a flow of the oil OL not flowing into the inflow port 54 but flowing toward the discharge port 55 on the facing surface 52*a*. As a result, a larger amount of the oil OL can flow into the inflow port 54 and can be supplied to the heat exchange unit side, so that the oil OL can be appropriately cooled. Since the partition wall portion 541 can be easily formed by press molding, a larger amount of the oil OL can flow to the heat exchange unit side with an inexpensive configuration.

The apparatus is not limited to the oil cooler 5. The apparatus also includes: a power transmission device that transmits output rotation of a driving source (an engine or a motor); and a known automatic transmission in the related art that includes a heat exchange unit for cooling the oil OL.

The power transmission device may or may not include a transmission mechanism that shifts rotation to be transmitted.

The partition wall that separates the inflow port 54 side and the discharge port 55 side may be as follows.

(a) The partition wall portion 521E that is provided across the straight line Lx that connects the centers of the inflow port 54 and the discharge port 55, and extends from the ring groove 53 to the vicinity of the center line C1 of the base plate 52E along the straight line L passing through the center line C1 of the base plate 52E (see FIG. 7A).

(b) The partition wall portion 521F that is provided across the straight line Lx that connects the centers of the inflow port 54 and the discharge port and extends along the straight line L passing through the center line C1 of the base plate 52E. One end and the other end of the partition wall portion 521F in the longitudinal direction reach the ring groove, respectively (see FIG. 7B).

With this configuration, the flow of the oil OL flowing toward the discharge port 55 instead of flowing into the inflow port 54 is prevented by the partition wall portion 521E and the partition wall portion 521F, so that a larger amount of the oil OL can flow into the inflow port 54 and can be supplied to the heat exchange unit side.

(2) The partition wall is one of the following partition walls.

(a) The partition wall portion 541B that is provided around the inflow port 54 (see FIG. 6B).

(b) The partition wall portion 551D that is provided around the discharge port 55 (see FIG. 6D).

(c) The semicircular surrounding wall that is formed by the inner annular wall portion 531G extending along the inner periphery of the ring groove 53, and the linear partition wall portion 521G passing through the center line C1, and the inflow port 54 being opened inside the semicircular surrounding wall (see FIG. 7C).

(d) The semicircular surrounding wall that is formed by the inner annular wall portion 531H extending along the inner periphery of the ring groove 53 and the linear partition wall portion 521H passing through the center line C1, and the discharge port 55 being opened inside the semicircular surrounding wall (see FIG. 7D).

With this configuration, a larger amount of the oil OL can flow into the inflow port 54 and can be supplied to heat exchange unit side. Accordingly, the oil OL can be appropriately cooled. In addition, a larger amount of the oil OL can flow to the heat exchange unit side with an inexpensive configuration.

(3) The partition walls is the partition wall portion 541 or the partition wall portion 541A provided so as to surround the inflow port 54 (see FIGS. 3B and 6A).

When the partition wall is provided only in the vicinity of the discharge port 55, movement of the oil OL from the inflow port 54 side to the discharge port 55 side can be suppressed, but the inflow amount of the oil OL discharged from the oil hole 14 into the inflow port 54 cannot be prevented from decreasing.

By providing the partition wall portion 541 so as to surround the inflow port 54, the inflow amount of the oil OL discharged from the oil hole 14 into the inflow port 54 can be ensured.

(4) The partition wall portion 541 and the partition wall portion 541A are each formed in a cylindrical shape surrounding the inflow port 54, and when the oil cooler 5 is assembled to the transmission case 1, the partition wall portion 541 or the partition wall portion 541A is brought into pressure contact with the peripheral edge of the oil hole 14, which is a fluid outlet, over the entire periphery to form a metal touch region.

With this configuration, the leakage of the oil OL from the contact interface between the partition wall portion 541 or the partition wall portion 541A on the facing surface 52*a* side and the peripheral edge of the oil hole 14 on the transmission case 1 side can be suitably suppressed, so that the inflow amount of the oil OL discharged from the oil hole 14 into the inflow port 54 can be ensured.

In addition, the leakage of the oil OL from the contact interface can be suitably suppressed with an inexpensive configuration.

(5) The support wall (the inner annular wall portion 531 and the outer annular wall portion 532) for preventing the inclination of the oil cooler with the partition wall portion 541 as a fulcrum are further provided on the facing surface 52*a* of the base plate 52 of the oil cooler 5 facing the transmission case 1.

The inner annular wall portion 531 and the outer annular wall portion 532 protrude from the facing surface 52*a* toward the transmission case 1.

When only the partition wall portion 541 surrounding the inflow port 54 protrudes from the facing surface 52*a*, the oil cooler 5 may be inclined with the partition wall portion 541 as a fulcrum.

By providing the support wall (the inner annular wall portion 531, the outer annular wall portion 532) separately from the partition wall portion 541, the oil cooler 5 can be suitably prevented from being inclined.

The support wall does not necessarily have to be annular, and may be any of the following support walls.

(a) The arc-shaped wall portion 531I that is provided along the inner periphery of the ring groove 53, on the side opposite to the partition wall portion 541A as viewed from the center line C1 (see FIG. 8A).

(b) The arc-shaped wall portion 532J that is provided along the outer periphery of the ring groove 53, on the side opposite to the partition wall portion 541A as viewed from the center line C1 (see FIG. 8B).

(c) The arc-shaped wall portion 531K that is provided at the position offset to the inner diameter side from the ring groove 53, on the side opposite to the partition wall portion 541A as viewed from the center line C1 (see FIG. 8C).

(d) The arc-shaped wall portion 532L that is provided at the position offset to the outer diameter side from the ring groove 53, on the side opposite to the partition wall portion 541A as viewed from the center line C1 (see FIG. 8D).

(e) Any combination of the arc-shaped wall portions of (a) to (d).

A shape of the support wall does not need to be an arc shape, and may be a linear shape or a wavy shape.

(6) The ring groove 53 that accommodates the seal ring SL is provided in the facing surface 52*a* of the main body case 51 of the oil cooler 5 facing the transmission case 1.

The support wall is at least one of the inner annular wall portion 531 along the inner periphery of the ring groove 53 and the outer annular wall portion 532 along the outer periphery of the ring groove 53.

The partition wall portion 541 is provided on an inner side of the ring groove 53.

The oil cooler 5 may be inclined with the partition wall portion 541 as a fulcrum. When the oil cooler 5 is inclined, sealing performance of the seal ring SL may be affected. According to the above-mentioned configuration, the inclination of the oil cooler 5 can be prevented by the support wall, so that leakage of the oil OL to the outer side of the seal ring SL due to the inclination of the oil cooler 5 can be suitably prevented.

In particular, the inflow port 54 is opened at a position close to the ring groove, and the partition wall portion 541 is not provided at a position close to a center of the ring groove (a position close to the center line C1). The oil cooler 5 is easily inclined due to the partition wall portion 541 protruding from the facing surface 52*a* though, the inclination of the oil cooler 5 can be more suitably prevented by providing the inner annular wall portion 531 and/or the outer annular wall portion 532.

(7) The height h541 of the partition wall portion 541 from the facing surface 52*a* is higher than the heights h531 and h532 of the support walls (the inner annular wall portion 531, the outer annular wall portion 532) from the facing surface 52*a*.

With this configuration, the metal touch region Rx1 formed due to the partition wall portion 541 is reliably formed at the contact interface between the base plate 52 and the peripheral wall portion 131. Accordingly, the oil hole 14 and the inflow port 54 are appropriately communicated with each other while preventing leakage of the oil OL from the contact interface between the rib 134 and the partition wall portion 541 of the base plate 52, and a larger amount of the oil OL can flow into the inflow port 54.

This invention can also be specified as an assembly structure of the oil cooler 5 with respect to the automatic transmission (a component to which the apparatus is assembled).

In the transmission case 1 of the automatic transmission, the oil hole 14 serving as the fluid outlet and the oil hole 15 serving as the fluid inlet are opened inside the peripheral wall portion 131, which is a region in which the oil cooler (the heat exchange apparatus) is assembled.

The oil cooler 5 includes:

the main body case 51 including the heat exchange unit; and the base plate 52 having the inflow port 54 through which the oil OL (the fluid) flows into the heat exchange unit and the discharge port through which the oil OL is discharged from the heat exchange unit.

In the base plate 52, the inflow port 54 and the discharge port 55 are opened in the facing surface 52*a* facing the transmission case 1.

The inflow port 54 is disposed to face the oil hole 14 which is a fluid outlet on the transmission case 1 side.

The partition wall portion 541 surrounding the inflow port 54 is formed on the facing surface 52*a* so as to bulge toward the transmission case 1 side, and separates the facing surface 52*a* into the inflow port 54 side and the discharge port 55 side.

When the oil cooler 5 is assembled to the peripheral wall portion 131, the partition wall portion 541 is brought into pressure contact with a peripheral edge portion of the oil hole 14 to form a metal touch region.

With this configuration, the leakage of the oil OL from the contact interface between the partition wall portion 541 on the facing surface 52*a* side and the peripheral edge portion of the oil hole 14 on the transmission case 1 side can be suitably suppressed, so that the inflow amount of the oil OL discharged from the oil hole 14 into the inflow port 54 can be ensured.

Although the embodiments of the invention have been described above, the invention is not limited only to the forms shown in these embodiments. The invention can be modified as needed within the scope of the technical concept of the invention.

The present application claims a priority of Japanese Patent Application No. 2020-45880 filed with the Japan Patent Office on Mar. 16, 2020, all the contents of which are hereby incorporated by reference.

The invention claimed is:

1. An apparatus, comprising:

a case including a heat exchange unit;

an inflow port through which a fluid flows into the heat exchange unit; and a discharge port through which the fluid is discharged from the heat exchange unit, wherein in the case, the inflow port and the discharge port are opened in a facing surface facing a component to which the apparatus is assembled, the inflow port and the discharge port are surrounded by a single seal member, the inflow port is disposed to face a fluid outlet of the component, and a partition wall that protrudes from the facing surface toward the component and separates an inflow port side and a discharge port side is provided on the facing surface, and the partition wall is provided so as to surround the inflow port.

2. The apparatus according to claim 1, wherein the partition wall is formed into a tubular shape surrounding the inflow port, and the partition wall is in pressure contact with a peripheral edge of the fluid outlet over an entire periphery when the apparatus is assembled to the component.

3. The apparatus according to claim 1, wherein a support wall for preventing inclination of the case with the partition wall as a fulcrum is further provided on the facing surface of the case facing the component.

4. The apparatus according to claim 3, wherein a ring groove that accommodates a seal ring is provided on the facing surface of the case facing the component, the support wall is at least one of an inner annular wall along an inner periphery of the ring groove and an outer annular wall along an outer periphery of the ring groove, and the partition wall is provided on an inner side of the ring groove.

5. The apparatus according to claim 4, wherein a height of the partition wall from the facing surface is higher than a height of the support wall from the facing surface.

* * * * *